US006044966A

United States Patent [19]

Haase

[11] Patent Number: 6,044,966

[45] Date of Patent: Apr. 4, 2000

[54] READY-FOR-SALE CONTAINER FOR TRANSPORTING CONTACT LENSES, AND CONTACT LENS PROVIDED FOR THIS CONTAINER

[75] Inventor: Lothar Haase, Schönberg, Germany

[73] Assignee: Wohlk Contact-Linsen GmbH, Germany

[21] Appl. No.: 09/104,414

[22] Filed: Jun. 25, 1998

[30] Foreign Application Priority Data

Jun. 25, 1997 [DE] Germany ..... 197 26 934
Sep. 16, 1997 [DE] Germany ..... 197 40 873

[51] Int. Cl.[7] ..... B65D 85/38

[52] U.S. Cl. ..... 206/5.1; 206/205; 206/504; 206/511

[58] Field of Search ..... 206/5.1, 504, 511, 206/512, 205; 220/23.4, 23.6

[56] References Cited

U.S. PATENT DOCUMENTS 3,509,813 5/1970 Appelt ..... 206/509
3,880,278 4/1975 Brown .
4,069,941 1/1978 Popplewell, Jr. et al. ..... 220/23.4
4,091,917 5/1978 Clawson et al. .
4,691,820 9/1987 Martinez .
4,711,356 12/1987 Dunden ..... 206/503
5,407,062 4/1995 Shannon et al. ..... 206/5.1
5,467,868 11/1995 Abrams ..... 206/5.1
5,609,246 3/1997 Borghorst et al. .
5,695,049 12/1997 Bauman .
5,722,536 3/1998 Pierce et al. ..... 206/5.1

FOREIGN PATENT DOCUMENTS 1130853 3/1966 United Kingdom .

*Primary Examiner*—Jim Foster

[57] ABSTRACT

A ready-for-sale container for transporting contact lenseshas at least one closable cavity that is open to the exterior and which receives at least one contact lens, onto which container inscriptions and identifications can be applied. The container is in one piece, made of a single material, of plastic, and a tear-off serves as the closure of the cavity. The contact lens is introduced into a container of this kind.

3 Claims, 3 Drawing Sheets

READY-FOR-SALE CONTAINER FOR TRANSPORTING CONTACT LENSES, AND CONTACT LENS PROVIDED FOR THIS CONTAINER

BACKGROUND OF THE INVENTION

1. Field of the Invention

The invention relates to a ready-for-sale container, for the transport of contact lenses, and more particularly, to a ready-for-sale container having at least one closable cavity, open to the exterior, for receiving the contact lens. Inscriptions and identifications can be applied to the container.

2. Description of Relevant Art

Such ready-for-sale containers for contact lenses are needed, on the one hand, in order to send the contact lenses from the producer to the point of sale, and on the other hand for the customer to carry the contact lenses home. Very many ready-for-sale containers are known which are capable of being opened and closed an optional number of times. These serve to facilitate transport of the contact lens on the one hand, and to facilitate cleaning of the contact lens on the other hand. These containers are usually quite complicated in construction and very expensive to produce. The containers of U.S. Pat. No. 4,091,917, British Patent UK 1,130,853, and U.S. Pat. No. 3,880,278 may be mentioned as examples of such containers.

Soft plastic packages having no stable shape are also known; however, these do not provide sufficient protection during transport for the contact lenses to be transported.

SUMMARY OF THE INVENTION

The invention has as its object to provide a ready-for-sale container for the transport of contact lenses which can be produced at a very favorable cost, which can be loaded very easily, and which offers sufficient safety for the contact lens during transport. This object is attained according to the invention by a ready-for-sale container for transporting contact lenses having at least one closable cavity that is open to the exterior for receiving at least one contact lens, onto which container inscriptions and identifications can be applied. The container is in one piece, made of a single material, and made of plastic, and a tear-off foil serves as the closure of the cavity. A contact lens is introduced into a container of this kind.

The ready-for-sale container according to the invention has at least one closable cavity, open to the exterior, to receive at least one contact lens, and inscriptions and identifications can be applied to the container.

To attain the object, the container is made in one piece, and of a single material, which is plastic; and a tear-off foil serves as the closure of the cavity.

Advantageously, the plastic material is PP (polypropylene), but any other material that can be processed by injection molding and can be deep drawn can be used for the container.

The thickness of the material of the container is chosen such that shape stability is insured, at least up to a pressure of two kilograms. Damage during storage and during the handling of the container is thus prevented as far as possible.

The base surface and/or cover surface of the container is of substantially rectangular shape in a top view, and the container is provided with laterally arranged walls between the base surface and the cover surface. This facilitates loading the container when sending contact lenses to the dealer.

The lateral walls of the container are at least partially oriented slightly inclined inward toward the cover surface.

At least one recess is provided near the base surface in at least one of the mutually opposing lateral walls, so that several containers can be stacked laterally. The recess should be arranged in the middle of the lateral wall, and the recess in one sidewall should be constituted as a through opening, this opening being, in the plane of the base surface, larger than 30% of the length of the side, and perpendicular to the plane of the base surface, at least greater than 25% of the height of the container.

The lateral walls of the container can be constructed at least of several straight surfaces. This is particularly the case when a groove which runs around the cover surface is formed in the lateral walls of the container, the width of this groove in the plane of the cover surface being at least equal to the wall thickness of the lateral walls in the plane of the base surface, and the depth of this groove perpendicular to the plane of the cover surface being at least one and a half times the wall thickness of the lateral walls in the plane of the base surface. The containers are thus easily stackable vertically.

The base surface within the laterally arranged walls and below the floor of the cavity is open in form, on the one hand leading to a considerable saving in weight and on the other hand making possible an inspection of a contact lens placed in the container if at least a middle portion of the floor of the cavity is transparent.

The cavity to receive the contact lens is constructed, for at least the major part, as a section of a sphere, with a radius of at least 15 mm, preferably 20 mm, in order to insure a good receiving surface for the contact lens.

The cover surface is smaller than the base surface, and the opening of the cavity is formed in the cover surface. This facilitates the removal of the contact lens from the container.

If the opening of the cavity is arranged centrally in the cover surface, enough space remains on the cover surface to apply inscriptions and identifications to the container. This is insured, in particular, when the distance of the opening of the cavity in the cover surface amounts to at least ten millimeters in all directions in the plane of the cover surface.

The diameter of the opening of the cavity in the cover surface is about half as large as the length and/or the width of the cover surface, so that the container is not too bulky.

The volume of the cavity is between one and three cubic millimeters, particularly when the cavity is to receive a soft contact lens, and in that case is filled, at least to the preponderant part, with a suitable liquid. It is also advantageous to fill the cavity with a suitable storage liquid when delivering hard contact lenses, since the liquid additionally protects the contact lens in the cavity from damage.

The cavity is closed by a foil of soft plastic; the flat edge around the opening of the cavity on the cover surface is at least three millimeters wide. This measure also insures an easy removal of the contact lens from the container, and the wide, flat edge provides a sufficient surface for adhesion to the closure foil, in order to be able to insure that there is no inadvertent separation of the foil from the container. The foil of course has an adhesive action only in the region of the adhesion surface with which it is provided. Either the contact lens is kept by suitable means from contact with the foil, or the adhesive used has no action on the material of the contact lens.

The contact lens according to the invention is installed in the container according to the invention.

BRIEF DESCRIPTION OF THE DRAWINGS

The invention is described hereinbelow in further detail by means of preferred embodiments and with reference to the accompanying drawings; the preferred embodiments in no way limit the invention, and contains further advantageous developments of the invention.

DETAILED DESCRIPTION OF PREFERRED EMBODIMENTS

Figure 1:
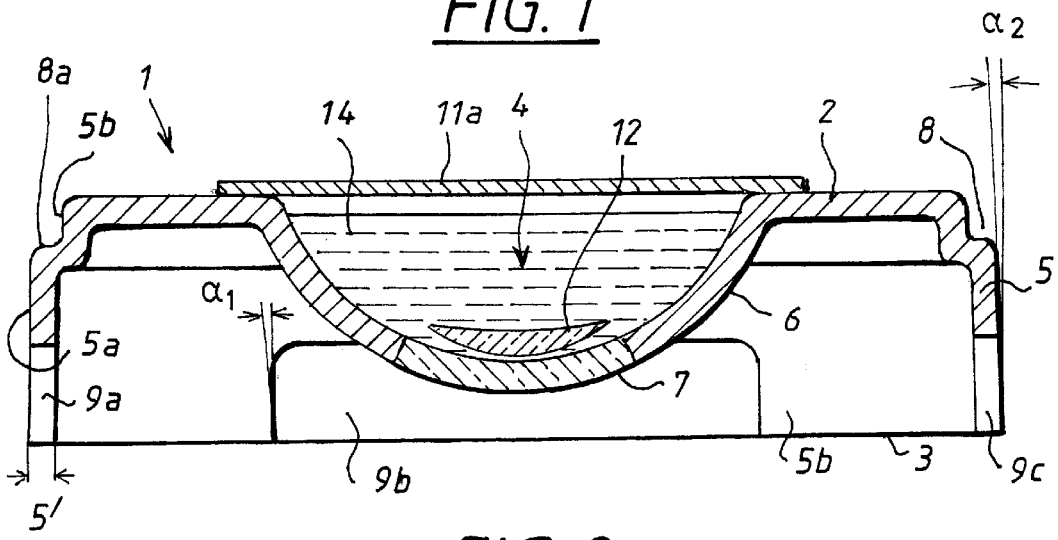
FIG. 1 shows a contact lens container according to the invention, in section.
Figure 2:
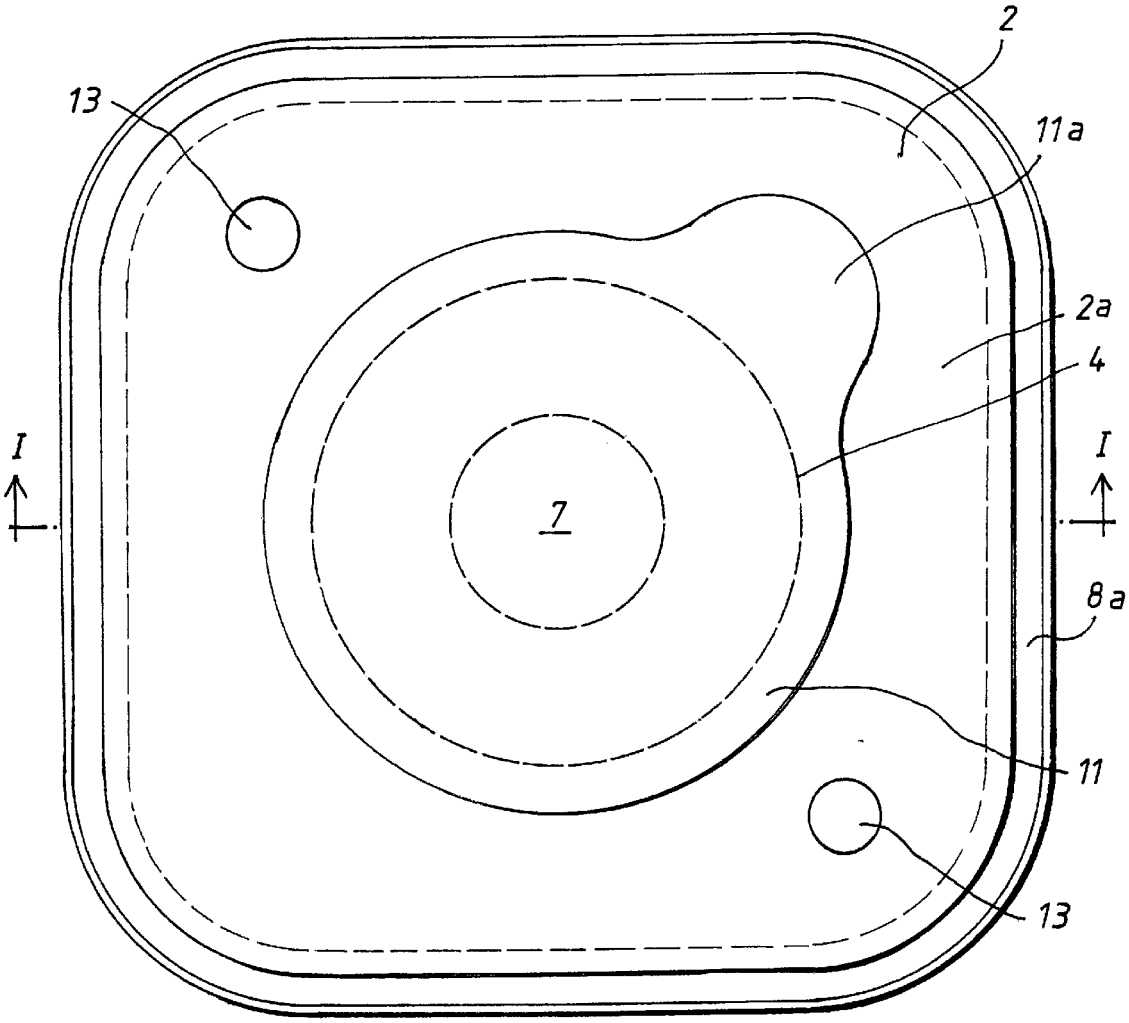
FIG. 2 shows the contact lens container of FIG. 1, in plan view.

The ready-for-sale container (1) shown in FIGS. 1 and 2 serves for transporting contact lenses (12) and therefore has a cavity (4) which is outwardly open for receiving the contact lens (12), and which is closed by means of an adhesive foil (11*a*) after insertion of the contact lens (12) and filling the cavity (4) with a storage liquid (14) according to the state of the art.

The container (1) is made in one piece and consists of a single material, the material being the plastic polypropylene (PP). However, any other material which can be processed by injection molding can be used for the container (1).

The wall thickness of the container (1) is about equally thick throughout, and is chosen such that the shape stability, at least in normal handling, insures as far as possible prevention of damage during storage and damage during handling of the container.

The container (1) has a substantially rectangular shape in plan view, with well-rounded corners. Lateral walls (5, 5*a*, 5*b*) are present between the base surface (3) and the cover surface (2) of the container. There are two or four through holes (13) in the cover surface (2), with a diameter of more than two millimeters. The packaging of the container (1), and delivery of the contact lenses (12) to the dealer is facilitated by the rectangular shape.

The lateral walls (5, 5*a*) of the container (1) are oriented such that on all sides they are inclined slightly inward toward the cover surface at an angle $\alpha_2$. The cover surface (2) is smaller than the base surface (3) because of the slightly inclined lateral walls (5, 5*a*, 5*b*), due to which the container (1) has a stable seating surface.

Recesses (9*a*, 9*b*, 9*c*) are formed in the lateral walls (5, 5*a*, 5*b*) near the base surface (3), in order to be able to stack several containers (1) laterally and in order to save weight. The recesses (9*a*, 9*b*, 9*c*) are located centrally in the lateral walls (5, 5*a*, 5*b*) and are formed as through openings.

The openings (9*a*, 9*b*, 9*c*) are greater than 30% of the length of the sides in the plane of the base surface (3), and are at least larger than 25% of the height of the container (1) perpendicular to the plane of the base surface (3).

The lateral walls (5, 5*a*, 5*b*) of the container (1) are constructed from several straight surfaces, in which case a groove (8) is formed in the lateral walls (5, 5*a*, 5*b*) of the container (1), running around at the cover surface (2). The width (8*a*) of this groove (8) in the plane of the cover surface (2) is greater than the wall thickness of the lateral walls (5, 5*a*, 5*b*) in the plane of the base surface, and the depth of this groove (8) perpendicular to the plane of the top surface (2) amounts to one and a half times the wall thickness of the lateral walls (5, 5*a*, 5*b*) in the plane of the base surface (3), so that several containers (1) are easily stackable vertically.

The circular opening of the cavity (4) is located in the cover surface (2). This facilitates removal of the contact lens (12) from the container (1). The cavity (4) serves for the reception of the contact lens (12) and of the storage liquid (14). It is embodied as a section of a sphere with a radius which is greater than the greatest radius of the contact lens (12) to be placed in the cavity (4). A good seating surface for the contact lens (1) is thereby insured by means of the floor of the cavity (4). The cavity (4) could also have another shape which is suitable for transporting contact lenses (12), but the above-mentioned spherical section shape impresses one as the simplest and most appropriate solution.

The opening of the cavity (4) is arranged in the middle of the cover surface (2). Sufficient space remains on the cover surface (2), because of the rectangular shape of the container (1), to permit the application of inscription foils and/or identification foils (not shown in the drawing) to or on the container (1). In order to ensure a sufficient free, flat surface around the cavity (4) on the cover surface (2), the distance of the opening of the cavity (4) in the cover surface (2) to the edge of the cover surface amounts to more than ten millimeters in all directions.

The volume of the cavity (4) is three cubic millimeters, in order to provide sufficient volume for both the soft contact lens (12) placed in it and for the storage liquid (14). This volume can in fact also be smaller, in particular when the storage liquid (14) is dispensed with (e.g., in the transport of hard contact lenses), since certain limits on a volume change are set by the geometry of the contact lens (12) itself. Filling the cavity with a suitable storage liquid (14) is also advantageous in delivering hard contact lenses (12), since the liquid (14) can additionally protect the contact lens (12) in the cavity (4) from damage.

The cavity (4), after the contact lens (12) is placed in it and after possible additional filling with a storage liquid (14), is closed by a tear-off foil (11) of soft plastic with a tear-off tongue (11*a*). In order to prepare a sufficiently large adhesion surface on the surface of the cover surface (2) around the opening of the cavity (4), a flat edge having a width of more than three millimeters must be present on the cover surface (2) around the opening of the cavity (4). The tear-off foil (11) can be extended over the whole cover surface (the openings 13 or 10 are to remain free if possible).

The tear-off tongue (11*a*) insures an easy removal of the tear-off foil (11), to facilitate taking the contact lens (12) out of the container (1). The wide flat edge around the opening of the cavity (4) prevents an inadvertent detachment of the foil (11) from the container (1).

The foil (11) of course has an adhesive action only in the region of the adhesive surface with which it is provided, or else the material of the adhesive used has no action on the material of the contact lens (12) and does not dissolve in the storage liquid (14).

The base surface (3) is open within the bounding walls (5, 5*a*, 5*b*) of the container (1) and beneath the floor of the cavity (4). This leads on the one hand to a considerable saving of weight, and on the other hand facilitates an inspection of a contact lens (12) placed in the cavity (4) of the container (1) in its storage liquid (14). In order to facilitate this possibility of monitoring, the middle portion (7) of the floor (6) of the cavity (4) is transparent. This transparency is insured by the material which was already mentioned at the beginning, so that in spite of this additional requirement the whole container (1) (as far as the tear-off foil (11)) can consist of a single, injection-moldable material.

The tear-off foil (11) can however also cover the whole cover surface (2) without thereby giving rise to limitations in the use of the inventive article. The passage holes (13) can then be pierced through when required.

Figure 3:
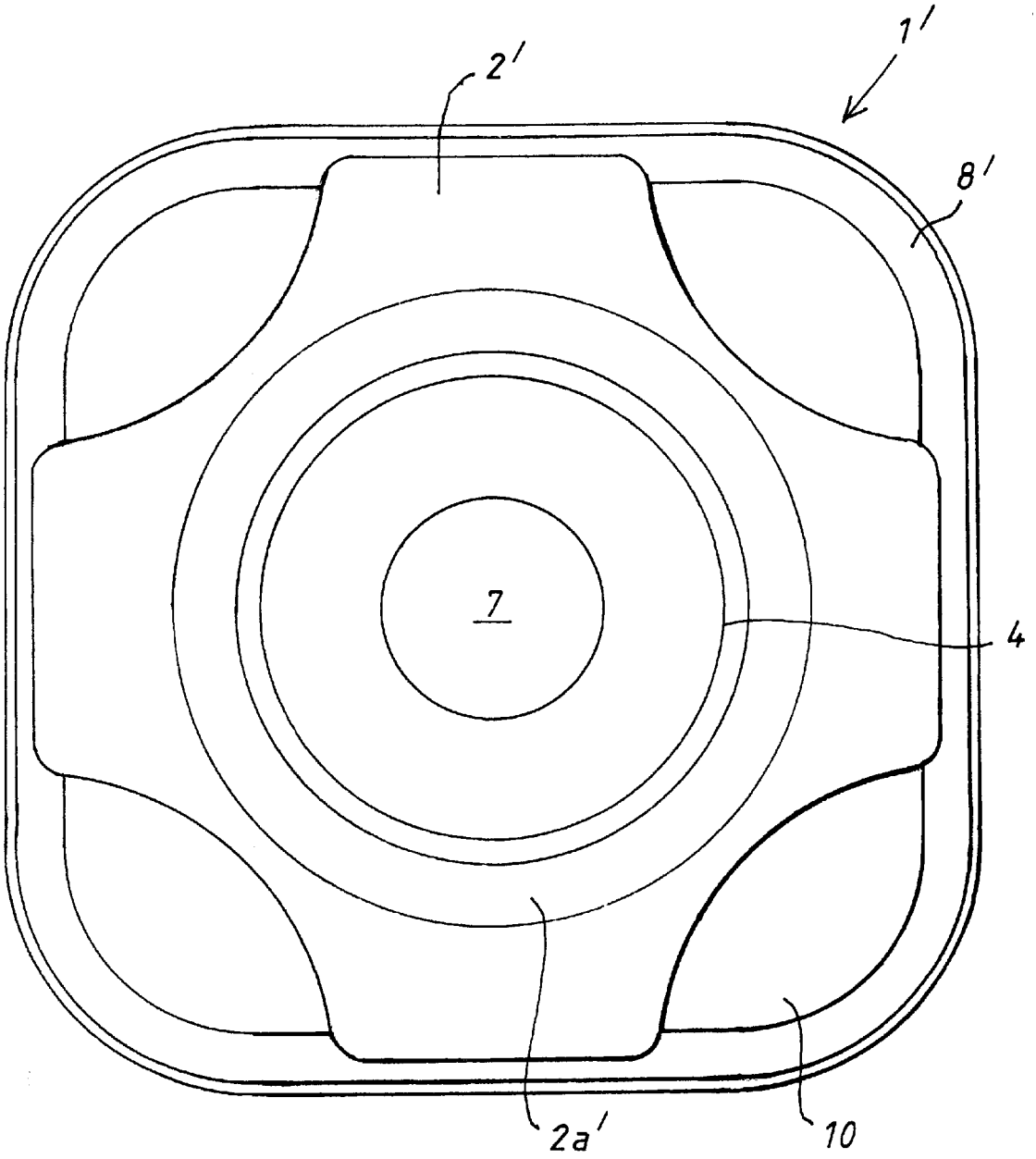
FIG. 3 shows a slight modification of the contact lens container shown in FIG. 2, in plan view.

The container (1') shown in FIG. 3 is in principle constructed and produced in exactly the same way as the container (1) shown in FIGS. 1 and 2. Its upper cover surface (2') around the opening (7') of the cavity (4') is however cross-shaped, so that a sufficiently wide adhesion ring **(2*a*') is still available around the opening (7'). The resulting recesses (10) in the cover surface (2') can either be open, or form a closed shoulder of the cover surface (2'). The upper cover surface (2'), which is shaped in the form of a cross, fits into the recesses (not shown in this Figure, see corresponding FIG. 1) of the lateral walls (not shown in this Figure, see corresponding FIG. 1). Even when the recesses (10) in the cover surface (2') are open, there remains sufficient flat surface on the cover surface (2')** to enable a foil bearing inscription foils and/or identification foils (not shown in the Figure) to be applied.

The inscription foils and/or identification foils (not shown in the Figure) can however also cover the whole cover surface (2'), without restrictions thereby arising on the use of the inventive article. The foil can then be pushed up from below when the recesses (10) are required, e.g., in order to be able to grip the package better.

Figure 4A:
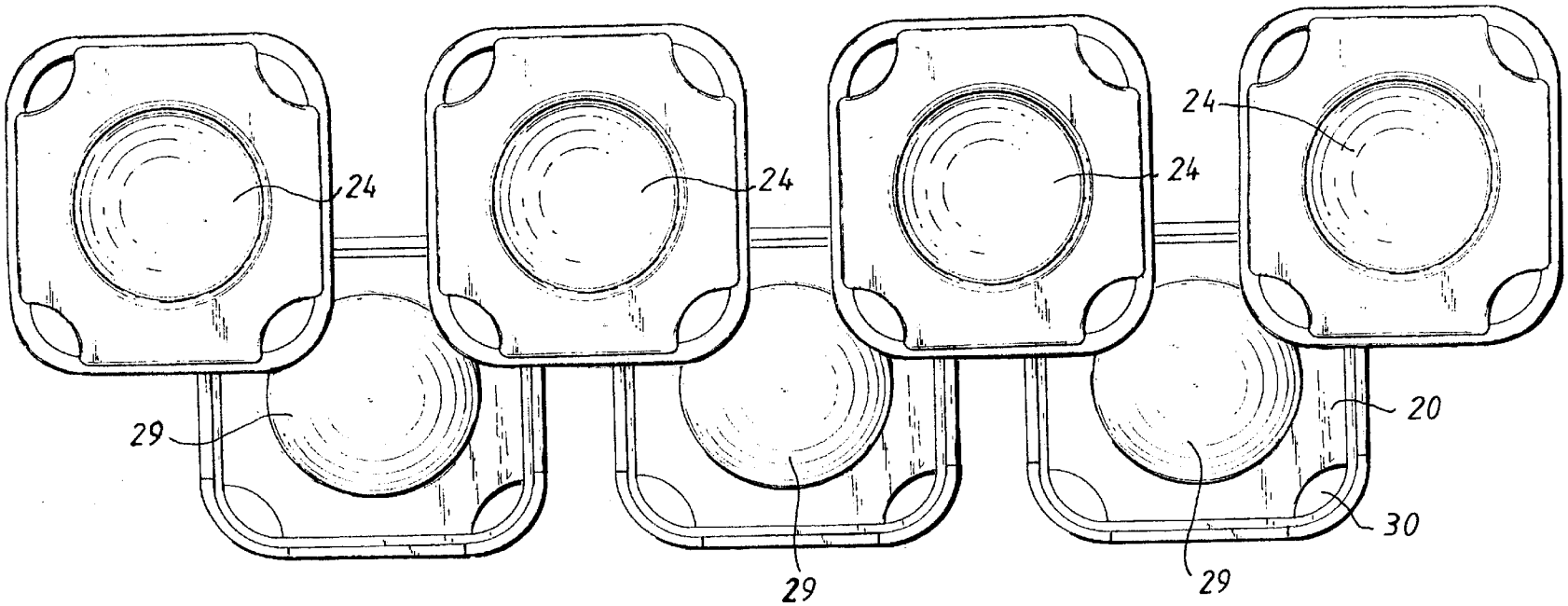
FIGS. 4*a* and 4*b* show a further modification of the contact lens container shown in FIG. 2, stacked in a sales package, respectively in plan view or side view, respectively.
Figure 4B:
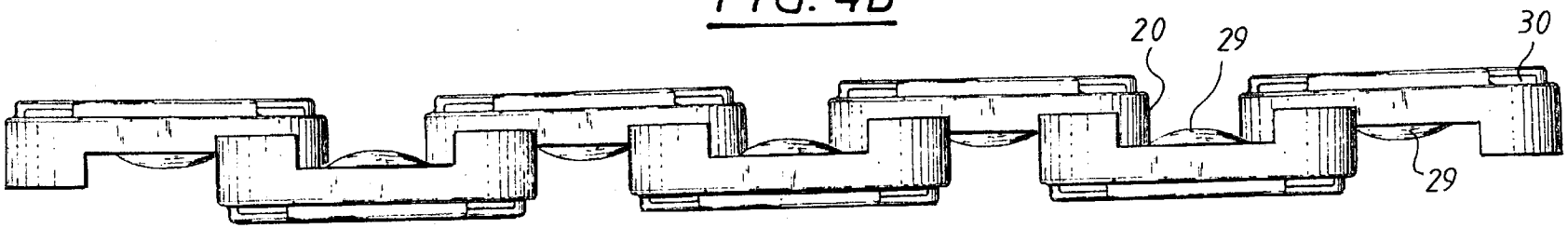

A further container (20) according to the invention is shown in FIGS. **4*a* and 4*b*. It has openings (29) in the form of segments of a circle at its four sidewalls (21). The cutouts (30) in the corner region have the same shape as the corners of the container (20) and thus permit several containers (20) to be stacked, secure against twisting, as a sale unit, as shown in FIGS. 4*a* and 4*b*. Here each successive container (20) lies, only in the region of a cutout (30), on the container (20) situated in front of it, and the successive containers (20) are arranged mutually offset laterally. The cavity (24) then has a large enough radius (R=13 mm) to insure a very good removal of the lenses from the container (20)**.

I claim:

1. A ready-for-sale container, comprising:

a top plate having a top surface, lateral walls, and a cavity arranged in the middle of said top plate receiving at least one contact lens and having an opening arranged in said top surface of said top plate, which top plate is connected to said lateral walls, wherein a groove with a surface arranged parallel to said top surface runs around said top plate and is formed in said lateral walls, wherein the distance from an outer edge of said top plate to an edge of said opening of said cavity is more than 10 millimeters in all directions.

2. A ready-for-sale container having a quadratic shape in plan view, comprising:

lateral walls on four sides of said container, wherein said four sides comprise two pairs of sides that are paralel to each other, a top plate having a top surface, wherein said top plate is connected to said lateral walls, a cavity arranged in the middle of said top plate receiving at least one contact lens and having an opening arranged in said top surface o f said top plate, and a groove with a surface arranged parallel to said top surface that runs around said top plate and is formed in said lateral walls.

3. A ready-for-sale container, comprising:

a top plate having a top surface, lateral walls, and a cavity receiving at least one contact lens and having an opening arranged in said top surface of said top plate, wherein said top plate is connected to said lateral walls, a groove with a surface arranged parallel to said top surface runs around said top plate and is formed in said lateral walls, and said lateral walls include openings that are greater than 30% of the length of said lateral walls.

* * * * *